US005361456A

United States Patent [19]

Newby, Sr.

[11] Patent Number: 5,361,456

[45] Date of Patent: Nov. 8, 1994

[54] HINGE CONFIGURATION

[75] Inventor: John P. Newby, Sr., Raleigh, N.C.

[73] Assignee: Southern Case, Inc., Raleigh, N.C.

[21] Appl. No.: 906,683

[22] Filed: Jun. 29, 1992

[51] Int. Cl.[5] ..... E05D 7/10

[52] U.S. Cl. ..... 16/257; 16/260

[58] Field of Search ..... 16/257, 259, 260

[56] References Cited

U.S. PATENT DOCUMENTS

| | | |
|---|---|---|
| 2,305,562 | 12/1942 | Thompson et al. . |
| 2,605,926 | 8/1952 | Casey . |
| 2,732,581 | 1/1956 | Heck . |
| 2,733,830 | 2/1956 | Ruskin . |
| 2,948,430 | 8/1960 | Teague, Jr. et al. . |
| 3,333,726 | 8/1967 | Belanger . |
| 3,984,028 | 10/1976 | Zinnbauer . |
| 4,282,983 | 8/1981 | Swartzbaugh . |
| 4,515,424 | 5/1985 | Sakurai . |
| 4,549,670 | 10/1985 | Trendler . |
| 4,570,437 | 2/1986 | Moritz . |
| 4,663,803 | 5/1987 | Gora . |
| 4,856,137 | 8/1989 | Palu . |
| 4,942,271 | 7/1990 | Corsi et al. . |
| 5,004,289 | 4/1991 | Lanser et al. . |

FOREIGN PATENT DOCUMENTS

| | | | |
|---|---|---|---|
| 2558512 | 7/1985 | France | 16/260 |
| 3414401 | 10/1985 | Germany | 16/260 |
| 2128245 | 4/1984 | United Kingdom | 16/259 |

*Primary Examiner*—Carmine Cuda

*Attorney, Agent, or Firm*—Bell, Seltzer Park & Gibson

[57] ABSTRACT

The invention regards a hinge interconnecting a first member and a second member for pivotal movement about an axis of rotation. The hinge comprises:

(a) a first member having a first pivot retaining portion and a second pivot retaining portion, each of the pivot retaining portions being fixed to the first rotatable member along the axis of rotation; and (b) a second member having a first post member matable with and axially insertable into the first retaining portion, and further having a second post member matable with and laterally insertable into the second retaining portion.

13 Claims, 2 Drawing Sheets

HINGE CONFIGURATION

FIELD OF THE INVENTION

This invention relates generally to hinge configurations for connecting two members for pivotal rotation, and relates more specifically to a hinge configuration integrally incorporated into two pivotally interconnected blow-molded pieces of a protective enclosure.

BACKGROUND OF THE INVENTION

In the design of a multiple component assembly, a primary concern of the designer is the fastening of the piece parts or components that comprise an overall assembly. The ease with which plastic parts can be molded into a wide variety of configurations and the relative elasticity of thermoplastics allow the designer to incorporate structural elements used in the attachment of the parts integrally into the piece part itself. Examples include the use of snap-fit type latches, the inclusion of a receiving boss for accepting a threaded screw, and structures comprising a hinge. Many different design configurations for plastic hinges incorporated into plastic piece parts are known. See, e.g., U.S. Pat. No. 2,948,430, issued Aug. 9, 1960 to W. D. Teague, Jr. et al., U.S. Pat. No. 4,549,670, issued Oct. 29, 1985 to Trendler, U.S. Pat. No. 3,333,726, issued Aug. 1, 1967 to P. J. Belanger, and U.S. Pat. No. 2,732,581 issued Jan. 31, 1956 to E. R. Heck.

A plastic molding technique that has become quite popular recently is blow molding. In blow molding, melted plastic is extruded through a dye to form a hollow shell (or "parison") with a specific wall thickness distribution. The parison is lowered between the core and the cavity halves of a mold. The mold halves close upon the parison; simultaneously, air or another suitable gas is injected into the interior of the parison to force the parison to stretch and conform to the mold surface. The result is a plastic part that has an external skin in the desired shape and a virtually empty internal core consisting of air pockets created by the injected gas. Blow molding can be advantageously used for large parts, which would require extremely high injection pressures if injection molded, and for thick parts, since the air pockets, or "voids", present in the core of the part affect the strength and rigidity of the part very little but reduce the amount of material required to make the part considerably.

For all of its advantages, blow molding is beset by some practical operational limitations. One of those limitations is the difficulty and expense of using "side-action" mechanisms within the mold. Side-action mechanisms create apertures and other structures oriented perpendicularly to the direction of mold travel by moving perpendicularly in response to the opening and closing of the mold. Side action mechanisms are particularly useful for molding integral fastening structures, such as receiving sockets for hinges, that are not oriented in the direction of mold travel. Exemplary is a hinged "clam shell" type enclosure: the mold core and cavity close and separate in the direction parallel to the sidewalls of the enclosure, so an integral hinge socket for fastening one half of the clam shell to its mating half is typically oriented perpendicular to the direction of mold travel. As such, the hinge socket must be formed with a retracting side action mechanism. In blow-molding, the use of side-action mechanisms is particularly undesirable, as the operation of a side action mechanism in a blow-molding mold requires that the portion of plastic the side action is to act upon must be stretched not only in the direction of mold travel, but also in the direction of the side action perpendicular to the direction of mold travel. This stretching thins that portion of plastic considerably, often so much that it completely loses its physical integrity and fractures. In addition, the inclusion of a side action mechanism in a mold increases the complexity of that mold; with increasing complexity comes increased cost for fabrication and maintenance. Because integral hinge structures typically require side-action mechanisms, blow-molded hinge structures are virtually unknown.

As a consequence, hinge structures included as part of an integral plastic design that do not require a mold with a side-action mechanisms are desirable, as such a design would facilitate the use of blow molding to make hinging parts. In view of this, it is an object of the present invention to provide a hinge design that can be molded integrally with the hinging parts without the use of side actions in the mold. It is a further object that such a design be easily assembled and have sufficient integrity as to be essentially permanent.

SUMMARY OF THE INVENTION

These objects and others are satisfied by the present invention, which includes a hinge interconnecting a first member and a second member for pivotal movement about an axis of rotation. The hinge comprises:

(a) a first rotatable member;

(b) a flexing member having a fixed end attached to the first rotatable member, a free end opposite the fixed end, and a concave arcuate surface, the arcuate surface being disposed above, extending along, and having a longitudinal axis parallel to the axis of rotation;

(c) a shoulder underlying and extending parallel to the axis of rotation and in adjacent relation to the flexing member having a fixed edge abutting the first rotatable member, a free edge opposite the abutting edge, and a retaining surface extending between the fixed edge and the free edge, so that, viewed from along the axis of rotation, the free end of the shoulder and the free end of the flexing member form a gap having a specified height when the flexing member is undeflected;

(d) a second rotatable member;

(e) a substantially semicylindrical ridge fixed to the second rotatable member and adapted for mating with the retaining surface of the shoulder having a longitudinal axis parallel to the axis of rotation; and (f) a post member adapted for mating with the arcuate surface of the flexing member having a fixed end attached to the rotatable member, a free end opposite the fixed end, a longitudinal axis extending from the free end to the fixed end, and a cammed surface extending from the free end toward the fixed end, the minimum distance from the cammed surface across the post member to the semicylindrical ridge being greater than the height of the opening of the hinge sleeve, and the post member being oriented such that the longitudinal axis of the post member is parallel to the longitudinal axis of the semicylindrical ridge; and (g) means for restraining the axial movement of the post member along the axis of rotation.

The first rotatable member and the second rotatable member are interconnected by first positioning the post member so that its longitudinal axis is aligned parallel the longitudinal axis of the hinge sleeve within the opening, the angled face contacts the free end, and the ridge contacts the shoulder. The post member and semicylindrical ridge are then moved toward the interior of the flexing member, hinge sleeve so that the free end of the flexing member slides along the calmed surface and deflects away from the axis of rotation, thereby increasing the size of the gap. Further movement of the post member and the semicylindrical ridge to a position within the hinge sleeve causes the free end returns to its original configuration, thereby permanently capturing the post member within the hinge sleeve. In a preferred embodiment, the hinge components are integrally formed with the first and second rotatable members in a blow-molding process.

DETAILED DESCRIPTION OF THE INVENTION

Figure 1:
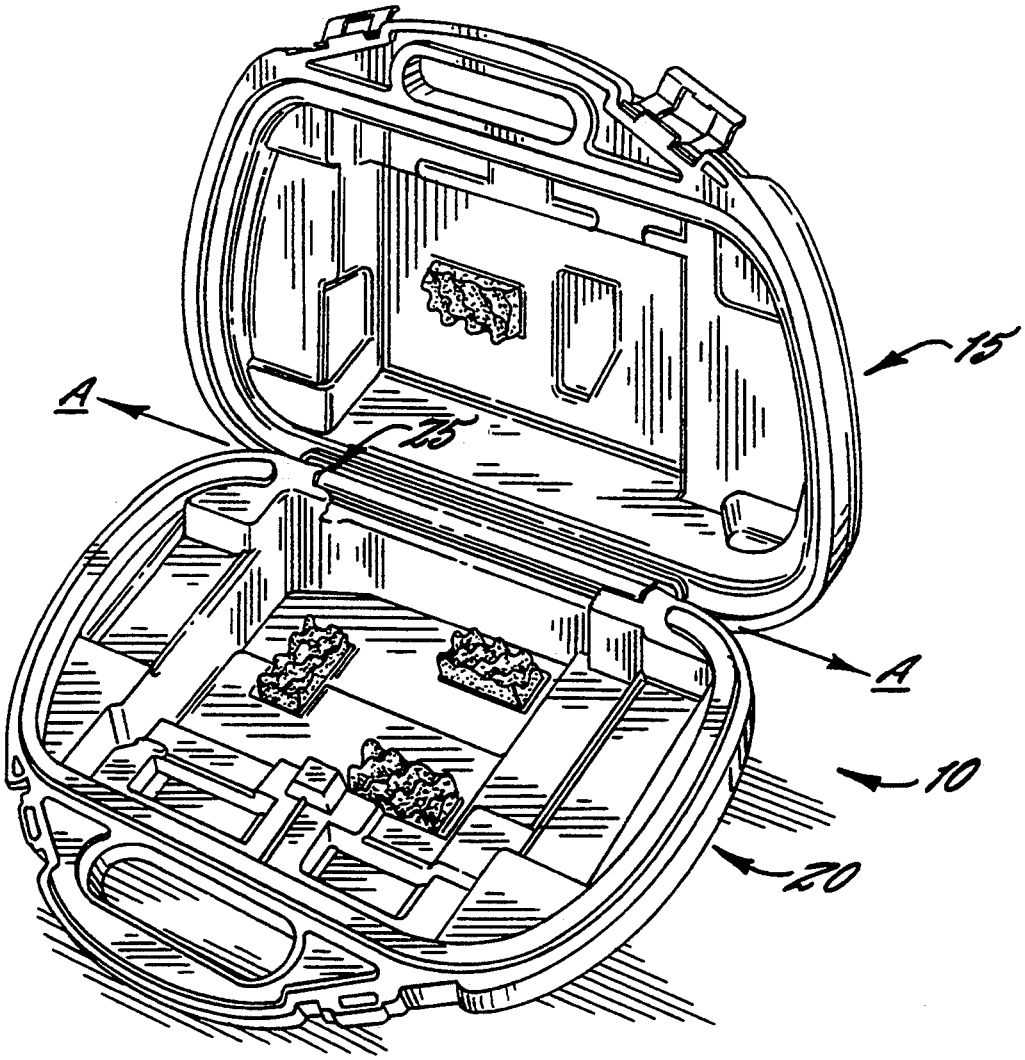
FIG. 1 is a front perspective view of an enclosure having hinged case and cover members, the enclosure being shown in an open condition.
Figure 2:
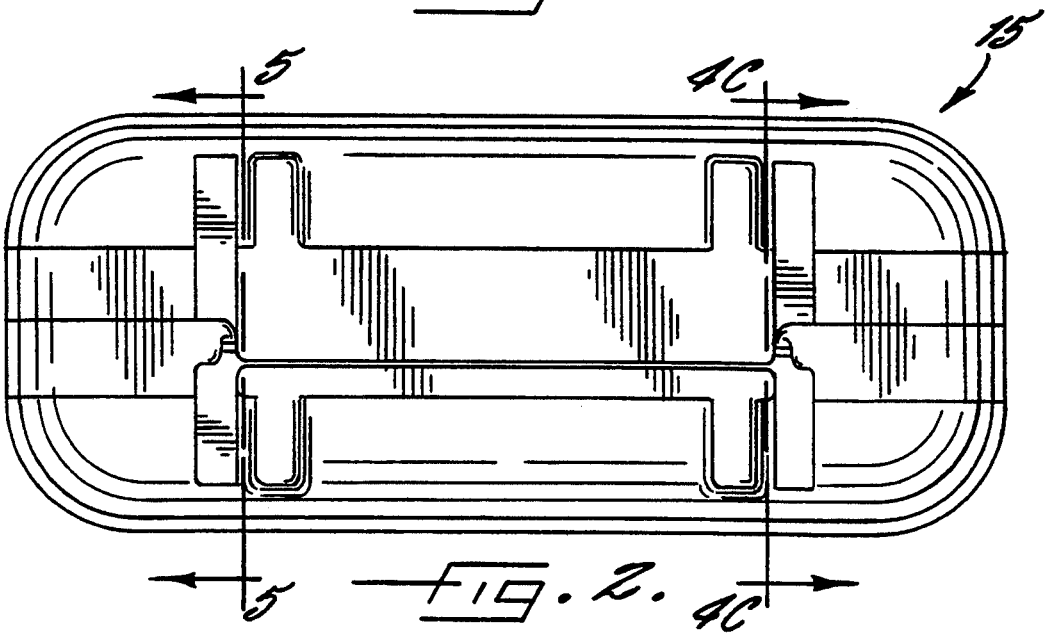
FIG. 2 is a rear elevational view of the enclosure in a closed condition.
Figure 3:
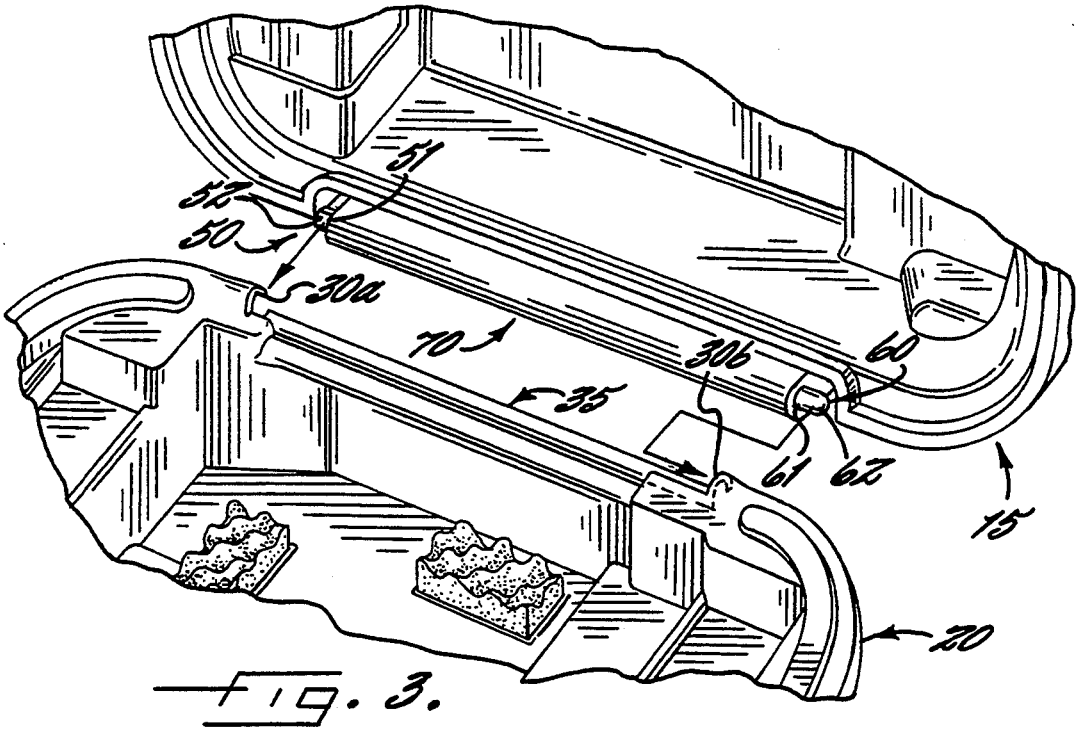
FIG. 3 is an enlarged fragmentary perspective view of the unassembled hinge illustrating the axial insertion of a cylindrical post and lateral insertion of a cammed post.

Referring now to the drawings, FIG. 1 shows a two-piece enclosure designated generally by the numeral 10 and comprising a cover 15 and a case 20 pivotally connected to each other by a hinge generally designated by the numeral 25. The cover 15 and the case 20 pivot relative to each other between an open position shown in FIG. 1 and a fully closed position about an axis of rotation identified by the letter A in FIG. 1. It will be understood by those skilled in the art that the hinge can be incorporated into the design of and used to pivotally interconnect other types of relatively rotatable members.

The hinge 25 comprises a pair of mirror image female hinge members 30*a* and 30*b*, a shoulder 35, a substantially cylindrical post member 60, a cammed post member 50, and a substantially semicylindrical ridge 70. Hinge members 30*a*, 30*b*, and shoulder 35 are molded integrally with case 20. Post members 50, 60 and the ridge 70 are molded integrally with cover 15. Those skilled in this art will recognize that the components of the hinge can be reversed (i.e., the female hinge members and the shoulder may be located on the cover, and the other structures on the case) without affecting the performance of the hinge.

Figure 4A:
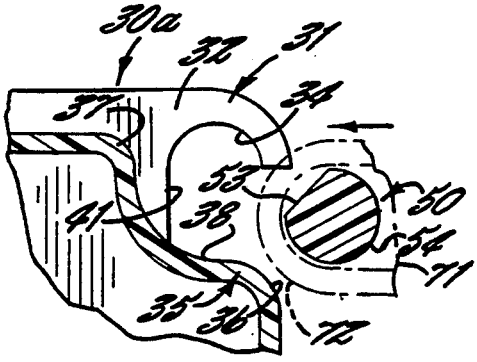
FIG. 4A is a view, partially in vertical section and partially in side elevation, of the cammed post and retaining sleeve in unmated relationship.
Figure 4B:
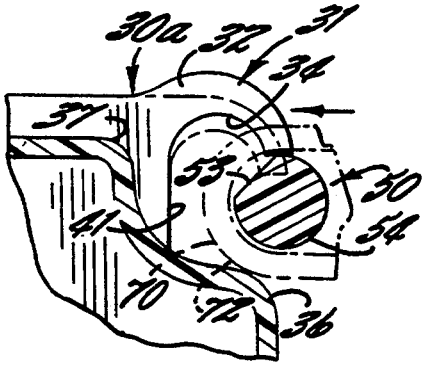
FIG. 4B is a view similar to FIG. 4A wherein the cammed post and retaining sleeve are in partially mated relationship.
Figure 4C:
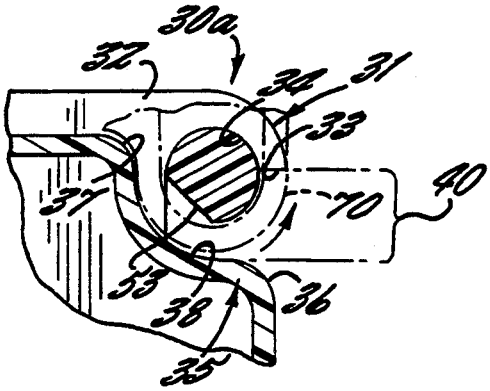
FIG. 4C is an enlarged sectional view taken along line 4C—4C of FIG. 2 and showing the cammed post and retaining sleeve in mated relationship.
Figure 5:
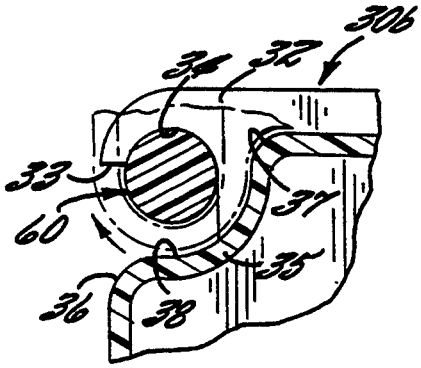
FIG. 5 is a sectional view taken along line 5—5 of FIG. 2 showing the assembled cylindrical post and retaining sleeve.

Hinge members 30*a*, 30*b* are mirror images of each other; only one will be described in detail. As seen in FIGS. 4A–C, each female hinge member comprises a flexing member 31 that is cooperable with a shoulder 35. Each flexing member 31 comprises a fixed end 32 attached to case 20, a free end 33 opposite fixed end 32, and a concave arcuate surface 34. Arcuate surface 34 extends between the free and fixed ends 33 and 32 of member 31, and is disposed above and extends axially parallel the axis of rotation A. Although illustrated in FIGS. 4A–4C and 5 as being substantially semicylindrical, the arcuate surface 34 can be any concave arcuate surface configuration suitable for rotatable mating with a post member (exemplified by post members 50 and 60 in FIGS. 4A–4C and 5), such as a quarter-cylinder, one-eighth cylinder, or the like. Flexing member 31 is sufficiently flexible as to receive the mating post member without fracturing, but is sufficiently rigid as to restrain the mating post member from lateral movement once the hinge has been assembled. Those skilled in the art will appreciate that any number of physical dimensions of flexing member are suitable for use in the hinge, and the appropriate dimensions for a given design will be influenced by the desired retention force of the hinge and the material comprising by the hinge.

As is best shown in FIGS. 3, 4A–C, and 5, shoulder 35 has a fixed end 36 attached to case 20, a free end 37 opposite fixed end 36, and a retaining surface 38 extending between fixed end 36 and free end 37. Shoulder 35 underlies and extends parallel to the axis of rotation A between and in adjacent relation to hinge members 30*a*, 30*b*. When viewed along the axis A while flexing member 31 is undeflected, the free end 32 of the flexing member 31 and free end 37 of the shoulder 35 define a gap 40 having a specified height. The retaining surface 38 can be arcuate, as shown in FIGS. 4A–C and 5, or can be flat; either configuration can suitably mate with the semicylindrical ridge 70. Fixed end 32 of the flexing member 31 and fixed end 36 of the shoulder 35 define a vertical wall portion 41 of case 20.

A cylindrical post member 60 has a fixed end 61 attached to cover 15, and has a free end 62. Member 60 has a longitudinal axis defined by a line extending from its fixed end 61 to its free end 62, which axis coincides with the axis of rotation A of cover 15. Member 60 is sized to mate with and rotate within retaining hinge compartment 30*b*. Those skilled in this art will recognize that any hinging means which permits rotation about the axis of rotation A and prevents axial movement of the cover 15 relative to the case 20 after insertion is suitable. This can include the substitution of a cammed post identical to cammed post 50 for which the cylindrical post 60, which allows an assembler to first insert either post axially prior to the lateral insertion of the opposite post member so that the left- or right-handedness of the assembler becomes irrelevant.

The cammed post member 50, which is adapted to mate with and rotate within hinge compartment 30*a*, has a fixed end 51, a free end 52, an axial cam surface 53, and an arcuate outer surface 64. Member 50 is fixed to the cover 15 adjacent the cover's fixed end 51 so that its longitudinal axis, defined by a line extending from the free end 52 to the fixed end 51, coincides with the axis of rotation A of cover 15. Surface 53 illustratively extends from fixed end 51 to free end 52 of member 50, and is substantially parallel to the longitudinal axis of member 50. However, the cammed surface need only extend from the free end 52 to a location on the outer axial surface 54 intermediate the free end 52 and the fixed end 51 which still permits lateral insertion of the post member 50 into hinge member 30*a*. The outer axial surface 54, shown as cylindrical in FIGS. 4A–C and 5, can be and illustratively is shaped so as to pivotally mate with hinge member 30*a*. The cammed surface 53 is radially oriented upon cammed post 50 so that, after insertion of post 50 in hinge member 30*b*, the cammed surface 53 faces free end 51 of the hinge member 30*a* in some rotative position between the fully opened position illustrated in FIG. 3, and a fully closed position.

Semicylindrical ridge 70 extends between the cylindrical post member 50 and cammed post member 60, and has a fixed edge 71 and a semicylindrical surface 72. Fixed edge 71 is attached to cover 15 and extends parallel to axis A. The semicylindrical surface 72 extends parallel to axis A from the fixed end 61 of cylindrical post member 60 to the fixed end 51 of the cammed post member 50. Surface 72 has a diameter which is suitable for mating with the retaining surface 38 of the shoulder 35. The minimum distance from cammed surface 53 to semicylindrical surface 72 measured normal to the cammed surface and through the cammed post member should be sufficiently greater than the height of the gap 40 as to ensure that cammed pin 50 will be retained within the hinge member 30*a* after insertion therein.

Cover 15 is connected to case 20 by first axially moving cylindrical post member 60 along the axis A and into hinge member 30*b*. Cammed post 50 is then moved to a position in which cammed surface 53 contacts free end 32 of flexing member 31 and semicylindrical surface 72 contacts free end 37 of shoulder 35. From this position cammed post member 50 is moved laterally toward vertical wall 41 of hinge member 30*a*. This movement causes free end 32 of flexing member 31 to slide along cammed surface 53 and to be deflected away from the axis of rotation A. Simultaneously, semicylindrical surface 72 of the ridge 70 slides over free end 37 of shoulder 35. This movement increases the height of gap 40. Further movement of the cammed post member 50 to a position entirely within the hinge member 30*a* causes free end 33 of flexing member 31 to return to its original undeflected position, in which flexing member 31 permanently captures the cammed post member 50. In this condition the longitudinal axes of hinge members 30*a* and 30*b*, the cylindrical post member 60, the cammed post member 50, and the ridge 70 coincide with the axis of rotation A, and cover 15 is able to pivot relative to case 20 from a closed position to an open position defined by stop means located on other portions of the enclosure.

The cover 15, cylindrical post member 60, cammed post member 50, and ridge 70 are preferably integrally formed, but can be constructed of multiple parts so long as the structural relationships as described are maintained. An integrally formed cover 15 preferably comprises a thermoplastic, such as polypropylene, polystyrene, acrylonitrile-butadiene-styrene terpolymer, or polyethylene, and more preferably comprises a blow-molded thermoplastic. Because the shoulder 35 does not directly underlie the hinge compartments 30*a*, 30*b*, but instead underlies them in adjacent relation, the mold for producing the cover requires no side-action mechanisms to integrally form the hinge members 30*a*, 30*b* and the shoulder 35.

Similarly, the case 20, the hinge compartments 30*a*, 30*b*, and shoulder 35 are integrally formed but can be constructed of multiple parts so long as the structural relationships of the hinge as described are maintained. An integrally formed case 20 preferably comprises a thermoplastic, such as polypropylene, polystyrene, acrylonitrile-butadiene-styrene terpolymer, or polyethylene, and more preferably comprises a blow-molded thermoplastic. The configuration of the post members 50 and 60 and the ridge 70 eliminates the need for any side-action mechanisms in the mold. Although blow molding is the preferred manufacturing techniques for this enclosure because of its size, it will be understood by those skilled in this art that both the cover 15 and the case 20 and their accompanying hinge structures can be integrally formed by other methods, such as injection molding, compression molding, and machining.

Although specific terms are employed, they are used in a generic and descriptive sense only and not for the purposes of limitation, the scope of the invention being defined in the following claims.

That which is claimed is:

1. A hinge interconnecting a first member and a second member for pivotal movement about an axis of rotation comprising:

(a) a first rotatable member;

(b) a flexing member having a fixed end attached to said first rotatable member, a free end opposite said fixed end, and a concave arcuate surface, said arcuate surface being disposed above, extending along, and having a longitudinal axis parallel to said axis of rotation;

(c) a shoulder underlying and extending parallel to said axis of rotation and in adjacent relation to said flexing member and having a fixed edge abutting said first rotatable member, and a free edge opposite said abutting edge, and a retaining surface extending between said fixed edge and said free edge, said free end of said shoulder and said free end of said flexing member forming, when viewed from along said axis of rotation, a gap having a specified height when said flexing member is undeflected;

(d) a second rotatable member;

(e) a substantially semicylindrical ridge member fixed to said second rotatable member, said ridge being adapted to abut said retaining surface of said shoulder having a longitudinal axis parallel to the axis of rotation; and (f) a post member matable with said arcuate surface of said flexing member and having a fixed end attached to said rotatable member, a free end opposite said fixed end, a longitudinal axis extending from said free end to said fixed end, and a cammed surface extending from said free end toward said fixed end, the minimum distance from said cammed surface across said post member to said semicylindrical ridge being greater than the height of said opening of said hinge sleeve, and being oriented such that the longitudinal axis of said post member is parallel to the longitudinal axis of said semicylindrical ridge; and (g) means for restraining the axial movement of said post member along the axis of rotation;

interconnection of said first rotatable member and said second rotatable member being effected by positioning said post member so that its longitudinal axis is aligned parallel the longitudinal axis of said hinge sleeve within said opening, said angled face contacts said free end, and said ridge contacts said shoulder, then effecting movement of said post member and said semicylindrical ridge toward said first rotatable member so that said free end of said flexing member slides along said cammed surface and deflects away from the axis of rotation, thereby increasing the size of said gap, and effecting further movement of said post member and said semicylindrical ridge to a position wherein said free end returns to its original configuration, thereby permanently capturing said post member within flexing member.

2. A hinge according to claim 1 wherein said first rotatable member, said flexing member, and said shoulder are integrally formed into a first single structure, and wherein said second rotatable member, said semicylindrical ridge, and said post member are integrally formed into a second single structure.

3. A hinge according to claim 2 wherein said first single structure comprises a thermoplastic and wherein said second single structure comprises a thermoplastic.

4. A hinge according to claim 2 wherein said first single structure comprises one unit of a hinged enclosure, and wherein said second single structure comprises a second unit of a hinged enclosure adapted to mate with said first unit.

5. A hinge according to claim 3 wherein said first said structure comprises a blow-molded thermoplastic, and wherein said second single structure comprises a blow-molded thermoplastic.

6. A hinge according to claim 1, wherein said semicylindrical ridge member has a radius of curvature, said post member has a maximum width normal to said longitudinal axis, and said radius of curvature of said semicylindrical ridge member is larger than said maximum width of said post member.

7. A hinge interconnecting two rotatable members for relative pivotal movement about an axis of rotation comprising:

(a) a first rotatable member;

(b) retaining means fixed to said first rotating member having an upper concave arcuate retaining surface, said surface being fixed on one edge to said first rotating member, having a free end, and being disposed above, extending along and having a longitudinal axis parallel to the axis of rotation, and a lower retaining surface having one edge abutting said first rotating member having one free edge opposite said abutting edge, and underlying and extending parallel to the axis of rotation, so that when viewed from along the axis of rotation, said free end of said upper retaining surface and the non-abutting edge of said lower retaining surface form an opening of having a specified undeflected height;

(c) a second rotating member;

(d) a ridge member fixed to said second rotating member, said ridge being adapted to abut said lower retaining surface, said ridge having a longitudinal axis parallel to the axis of rotation;

(e) a post member having a fixed end attached to said second rotating member, a free end, a longitudinal axis extending from said fixed end to said free end, a cammed surface extending from said free end to said fixed end, and an outer axial surface extending along the longitudinal axis of said post member opposite said cammed surface, said post member being configured so that the maximum distance between the cammed surface and the ridge member is greater than the height of the opening of said retaining means; and (f) means for restraining the axial movement of said post member along the axis of rotation;

interconnection of said first member and said second member being effected by positioning said second rotatable member so that said post member is aligned parallel the axis of rotation, said ridge contacts said lower retaining surface, and said cammed surface contacts said free end of said retaining means of said first rotatable member, then effecting relative movement of said post member toward said first rotating member so that said free end of said upper retaining surface retaining means slides along said cammed surface and said cammed surface deflects said upper retaining surface free end away from the axis of rotation, thereby increasing the size of said opening, and then effecting further relative movement of said post member toward said first rotatable member to a position within said retaining means which permits said upper retaining surface free end to return to its original configuration, thereby permanently capturing said post member within said retaining means.

8. A hinge according to claim 7, wherein said first rotatable member comprises a first component of an enclosure unit, and wherein said second rotatable member comprises a second component of an enclosure unit.

9. A hinge according to claim 8, wherein said first rotatable member and said retaining means are integrally formed as a first single unit, and wherein said second rotatable unit and said post member are formed as a second single unit.

10. A hinge according to claim 9, wherein said first single unit comprises a thermoplastic, and wherein said second single unit comprises a thermoplastic.

11. A hinge according to claim 10, wherein said first single unit comprises a blow-molded thermoplastic unit, and wherein said second single unit comprises a blow-molded thermoplastic unit.

12. A hinge according to claim 7 wherein said means for restraining the axial movement of said post member along said axis of rotation comprises:

(a) second retaining means comprising means fixed to said first rotating member having an upper concave arcuate retaining surface, said surface being fixed on one edge to said first rotating member, having a free end, and being disposed above, extending along and having a longitudinal axis parallel to the axis of rotation, and a lower retaining surface having one edge abutting said first rotating member having one free edge opposite said abutting edge, and underlying and extending parallel to the axis of rotation, so that when viewed from along the axis of rotation, said free end of said upper retaining surface and the non-abutting edge of said lower retaining surface form an opening having a specified undeflected height; and (b) a second post member having a fixed end attached to said second rotatable member and a free end, said fixed end and said free end defining a longitudinal axis extending parallel to the axis of rotation, said free end of said second post member facing away from said free end of said first post member;

and wherein interconnection of said first member and said second member is effected by axially positioning said second post member within said second retaining means prior to the movement of said first post member toward said first rotatable member.

13. A pivotally interconnected enclosure comprising:

(a) a blow-molded first rotatable member having
(i) a pair of flexing members each having a fixed end attached to said first rotatable member, a free end opposite said fixed end, and a concave arcuate surface, said arcuate surface being disposed above, extending along, and having a longitudinal axis parallel to the axis of rotation;
(ii) a shoulder underlying and extending parallel the axis of rotation and in adjacent relation to said flexing member having a fixed edge abutting said first rotatable member, and a free edge opposite said abutting edge, and a retaining surface extending between said fixed edge and said free edge, so that, viewed from along the axis of rotation, said free end of said shoulder and said free end of said flexing member form a gap having a specified height when said flexing member is undeflected; and
(b) a blow-molded second rotatable member comprising:
(i) a substantially semicylindrical ridge fixed to said rotating member and adapted for mating with said retaining surface of said shoulder having a longitudinal axis parallel to the axis of rotation;
(ii) a post member adapted for mating with said arcuate surface of said flexing member having a fixed end attached to said rotatable member, a free end opposite said fixed end, a longitudinal axis extending from said free end to said fixed end, and a cammed surface extending from said free end toward said fixed end, the minimum distance from said cammed surface across said post member to said semicylindrical ridge being greater than the height of said opening of said hinge sleeve, and being oriented such that the longitudinal axis of said post member is parallel to the longitudinal axis of said semicylindrical ridge; and
(iii) a cylindrical post member attached adjacent said semicylindrical ridge having a longitudinal axis parallel to said cammed post member; interconnection of said first rotatable member and said second rotatable member being effected by first axially inserting said cylindrical post member into one of said pair of flexing members, positioning said second rotatable member so that its longitudinal axis is aligned parallel the longitudinal axis of said flexing member sleeve within said opening, said cammed surface contacts said free end, and said ridge contacts said shoulder, then effecting movement of said post member and said semicylindrical ridge toward said first rotatable member so that said free end of said flexing member slides along said cammed surface and deflects away from the axis of rotation, thereby increasing the size of said gap, and effecting further movement of said post member and said semicylindrical ridge to a position wherein said hinge sleeve so that said free end returns to its original configuration, thereby permanently capturing said post member with said flexing member.

* * * * *